United States Patent [19]

Abe et al.

[11] Patent Number: 4,909,866

[45] Date of Patent: Mar. 20, 1990

[54] HIGH STRENGTH SPRING AND ITS PROCESS OF MANUFACTURING

[75] Inventors: Makoto Abe, Zushi; Tetsuyuki Taniguchi, Fujisawa; Tsuyoshi Kuriki, Yokohama; Noritoshi Takamura, Kanagawa; Naoki Terakado; Kaoru Hatayama, both of Nagano, all of Japan

[73] Assignees: Nissan Motor Co., Ltd.; NHK Spring Co., Ltd., both of Yokohama, Japan

[21] Appl. No.: 249,637

[22] Filed: Sep. 22, 1988

[30] Foreign Application Priority Data

Sep. 25, 1987 [JP] Japan ..... 62-238926

[51] Int. Cl.[4] ..... C22C 38/18; F16F 1/06

[52] U.S. Cl. ..... 148/333; 267/166; 29/173; 148/334; 148/908

[58] Field of Search ..... 148/908, 333, 334, 12 B; 267/166, 167, 286; 72/53; 29/173

[56] References Cited

U.S. PATENT DOCUMENTS 3,585,086 6/1971 Hrusovsky ..... 148/908

FOREIGN PATENT DOCUMENTS 59-170241 9/1984 Japan ..... 148/908

61-183413 8/1986 Japan ..... 148/12 B

*Primary Examiner*—Deborah Yee

*Attorney, Agent, or Firm*—Foley & Lardner, Schwartz, Jeffery, Schwaab, Mack, Blumenthal & Evans

[57] ABSTRACT

A high strength spring is made of steel of which composition consists of 0.6 to 0.7 wt % of C, 1.2 to 1.6 wt % of Si, 0.5 to 0.8 wt % of Mn, 0.5 to 0.8 wt % of Cr, 0.05 to 0.2 wt % in total of one or more than one of V, Mo, Nb and Ta and the balance of Fe and inevitable impurities. The steel is limited in particle size of non-metallic inclusions in such a way that the maximum particle size of the non-metallic inclusions is equal to or smaller than 15 μm. The spring is applied at a portion adjacent the outer surface thereof with a residual compression stress in such a way that the maximum of the residual compression stress ranges from 85 to 110 Kgf/mm$^2$. The spring is further process so as to have such a surface roughness that is equal to or smaller than 15 μm.

6 Claims, 2 Drawing Sheets

HIGH STRENGTH SPRING AND ITS PROCESS OF MANUFACTURING

BACKGROUND OF THE INVENTION

1. Field of the Invention

The present invention relates to a spring which is highly strong so that it is capable of enduring a severe fatigue loading and more specifically to a high strength spring suited for use as a valve spring for an internal combustion engine.

2. Description of the Prior Art

Of the prior art high strength springs, a valve spring for an internal combustion engine has heretofore been made of a material as, for example, SWO-V (spring steel wire according to JIS G3561, i.e., Japanese Industrial Standard G3561), SWOCV-V (spring steel wire according JIS G3565 and SWOSC-V (spring steel wire according to JIS G3566).

To this end, it has recently begun to use o super SWOSC-V (hereinafter referred to as SWOSC-V*) which is improved in strength and attained by further reducing the content of the inclusions in the above described SWOSC-V.

While SWOSC-V* is considerably improved in strength as compared with SWOSC-V, it is still insufficient in strength in order to satisfactorily improve a valve drive train in maximum operation speed and friction for thereby attaining a desired high efficiency and low fuel comsumption of an associated engine. It is therefore eagerly desired to develop a new valve spring which is compact in size, light in weight and of a high strength as well as being stable in quality and highly reliable in operation.

SUMMARY OF THE INVENTION

In accordance with the present invention, there is provided a novel high strength spring which is characterized in that the steel has the following composition by weight, carbon: 0.6 to 0.7%, silicon: 1.2 to 1.6%, Manganese: 0.5 to 0.8%, Chromium: 0.5 to 0.8%, one or more than one of vanadium, molybdenum, niobium and tantalam: 0.05 to 0.2% in total, nd the balance of iron and inevitable impurities. The steel is limited in particle size of non-metallic inclusions in such a way that the maximum particle size of the non-metallic inclusions is equal to or smaller than 15 μm. The spring is applied with a residual compression stress at a portion adjacent the outer surface thereof in such a way that the maximum of said residual compression stress ranges from 85 to 110 Kgf/mm$^2$. The spring is further processed so as to have such a surface roughness that is equal to or smaller than 15 μm.

In accordance with the present invention, there is also provided a method of producing a high strength spring which comprises the steps of: preparing steel of which composition consists of 0.6 to 0.7 wt % of carbon, 1.2 to 1.6 wt % of silicon, 0.5 to 0.8 wt % of manganese, 0.5 to 0.8 wt % of chromium, 0.05 to 0.2 wt % in total of one or more than one of vanadium, molybdenum, niobium and tantalum, and the balance of iron and inevitable impurities, the maximum particle size of non-metallic inclusions being limited so as to be equal to or smaller than 15 μm; forming the spring from the steel; applying to the spring adjacent to the outer surface thereof a residual compression stress in such a manner that the maximum of said residual compression stress ranges from 85 to 110 Kgf/mm$^2$; and processing the spring in such a way that the surface roughness is equal to or smaller than 15 μm.

The above spring and method of producing the same can meet the above noted requirements.

It is accordingly an object of the present invention to provide a novel high strength spring which is highly strong so as to be capable of enduring a particularly sever fatigue loading.

It is another object of the present invention to provide a novel high strength spring of the above described character which can improve a valve train in maximum operation speed and friction satisfactorily and thereby improve the performance efficiency and fuel consumption of an associated engine.

It is a further object of the present invention to provide a novel high strength spring of the above described character which is compact in size and light in weight and of a high strength as well as being stable in quality and highly reliable in operation.

DESCRIPTION OF THE PREFERRED EMBODIMENTS

Figure 1:
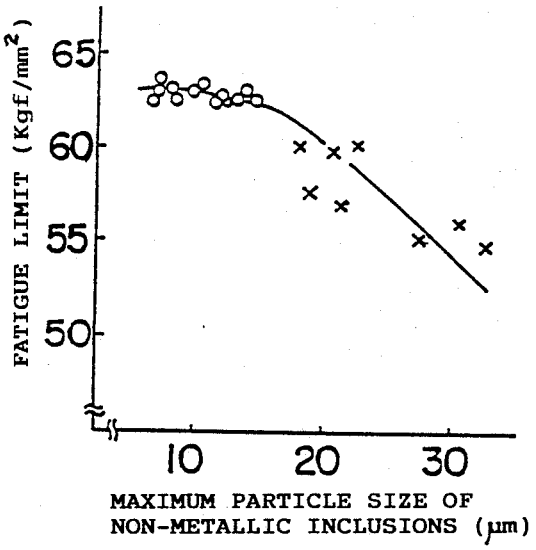
FIG. 1 is a graph depicting an experimental result of a relation between a maximum grain or particle size of non-metallic inclusions contained in a spring material and a fatigue limit of the spring material.

A high strength spring of this invention is made of a material of which composition consists of 0.6 to 0.7 wt % of C, 1.2 to 1.6 wt % of Si, 0.5 to 0.8 wt % of Mn, 0.5 to 0.8 wt % of Cr, 0.05 to 0.2 wt % in total of one or more than one of V, Mo, Nb and Ta and the balance of Fe and inevitable impurities. The material is limited in particle size of non-metallic inclusions in such a way that the maximum particle size of non-metallic inclusions is equal to or smaller than 15 μm. The spring is applied with a residual compression stress in such a way that the maximum residual compression stress in the portion of the spring adjacent to the outer surface thereof is 85 to 110 kgf/mm$^2$. The spring is further processed so as to have such a surface roughness Rmax that is equal to or lower than 15 μm.

The effects of the respective alloying elements and the reasons for the limitations on the amounts of the respective elements are as follows. Throughout the following description, the amounts of the elements in the spring material are given in percentages by weight.

(1) Carbon: 0.6 to 0.7%

Carbon is an indispensable element in order to provide a strength to a spring. When the content of carbon is lower than 0.6%, a sufficient strength cannot be attained. On the other hand, when exceeding 7%, the toughness is reduced to deteriorate the productivity. For this reason, a suitable range of content of carbon is from 0.6 to 0.7%.

(2) Silicon 1.2 to 1.6%

Silicon is an element of relatively low price and effective for increasing the ferrite strength and at the same time reducing the distances between the adjacent carbides after an oil temper process for thereby improving the resistance to setting of the spring. However, when the content is lower than 1.2%, it cannot produce a sufficient effect. On the other hand, when exceeding 1.6%, it not only reduces the toughness of the spring but remotes decarburization, thus being causative of producing non-metallic illusions during steel making processes and therefore reducing the strength and the reliability. For this reason, a suitable range of silicon is from 1.2 to 1.6%.

(3) Manganese: 0.5 to 0.8%

Manganese is an element which is effective for fixation of sulfur for thereby preventing its harm otherwise caused and also effective for deoxidation. However, when the content is lower than 0.5%, it cannot be sufficiently effective. On the other hand, when exceeding 0.8%, the hardenability is increased so the cystalline form of the sprig material is liable to be bainite or martensite during hot rolling, thus reducing the toughness and the ease and stability of production. For this reason, a suitable range of content of manganese is from 0.5% to 0.8%.

(4) Chromium: 0.5 to 0.8%

Chromium is an element for providing a toughness to the spring material when processed by a patenting treatment after hot rolling and increasing the resistance to temper softening a the time of an oil temper treatment for thereby attaining the high strength. Chromium is further effective for reducing the carbon activity and preventing decarburization at the time of heat treatment. However, when the content is lower than 0.5%, its effectiveness is too small. On the other hand, when added so as to exceed 0.8%, not only the resistance to setting is reduced, but the hardenability is increased excessively, thus reducing tee toughness. For this reason, a suitable range of the content of chromium is from 0.5% to 0.8%.

(5) One or more than one of vanadium, molybdenum, niobium and tantalum: 0.05 to 0.2% in total Vanadium, molybdenum, niobium and tantalum are elements particularly effective for improving the resistance to setting and preventing decarburization similarly to chromimum. Furthermore, they are considerably effective for refining the grains and providing a toughness to the spring material for thereby increasing the reliability. When the content is lower than 0.05%, it is not sufficiently effective. On the other hand, when added to exceed 0.2%, the cost is increased too high and their handling in production becomes difficult. For this reason, a suitable range of content of one or more than one of vanadium, molybdenum, niobium and tantalum is from 0.05 to 0.2% in total.

The reasons for the limitation that the size of non-metallic inclusions are equal to or smaller than 15 μm are as follows:

In comparison with the prior art SWOSC-V, the steel for the high strength spring of this invention is increased in the content of C and added with one or more than one of V, Mo, Nb and Ta for thereby increasing the strength. Due to this, the notch sensitivity is increased and if the inclusions of a large particle size are contained in the material the fatigue strength is also reduced. For this reason, in order to obtain a high strength spring of a high reliability, it is inevitable to specify the particle size of the non-metallic inclusions. By the various experiments, it was found that if it is possible to control the particle size of the non-metallic inclusions below 15 μm the content of the non-metallic inclusions can be correspondingly reduced, whereby the reduction of the fatigue strength by the effect of the non-metallic inclusions can be smaller. For this reason, it is desirable that the maximum particle size of non-metallic inclusions is limited to 15 μm.

While the high strength spring of this invention is made of steel of the above described composition and of the kind in which the particle size of the non-metallic inclusions in the steel is limited in the above described manner, it still to cannot attain a desired high strength and is needed to be treated by a shot peening or the like so as to be applied with a desired residual compression stress at the portion adjacent the outer surface thereof. Further, since the high strength spring of this invention has a high notch sensitivity, it effects, in spite of the application of the residual compression stress, such a phenomenom that the fatigue strength reduces as the surface roughness increases.

Accordingly, in the high strength spring of this invention, the following limitations are made to the surface roughness and the residual compression stress at the portion of the spring adjacent the outer surface.

The reasons for the limitation that the maximum residual compression stress at the portion of the spring adjacent outer surface is within the range of 85 to 110 Kgf/mm$^2$ are as follows:

The residual compression stress at the portion of the spring adjacent the outer surface has a considerable effect for increasing the fatigue strength. However, when the maximum residual compression stress at and adjacent th outer surface is smaller than 85 Kgf/mm$^2$, a pronounced increase of the fatigue strength is not obtained. For this reason, it is necessary for the spring to be applied with a maximum residual compression stress which is equal to or larger than 85 Kgf/mm$^2$ by a shot peening process or the like. However, when the maximum residual stress exceeds 110 Kgf/mm$^2$, not only the production difficulty arises but the reliability on the spring operation characteristics reduces. Furthermore, the surface roughness which will be described hereinlater is also reduced, thus reducing the fatigue strength adverely. For this reason, a suitable range of the maximum residual compression stress adjacent the outer surface of the spring is from 85 to 110 Kgf/mm$^2$.

The reasons for the limitation that the surface roughness Rmax is equal to or smaller than 15 μm are as follows:

Making the surface of the spring smooth, i.e., a small surface roughness is considerably effective for increasing the fatigue strength of the high strength spring of this invention. When the surface roughness Rmax exceeds 15 μm, an apparent reduction of the fatigue strength is recognized. For this reason, a suitable surface roughness Rmax is equal to or smaller than 15 μm. The surface roughness Rmax smaller than 5 μm can increase the fatigue strength only a quite bit but makes it difficult to attain a uniform and stable production. In view of the mass productivity, a suitable range of the maximum surface roughness Rmax is from 5 to 15 μm.

While the high strength spring of this invention is particularly suited for a valve spring for an internal combustion engine and in such a case it is in the form of a coil spring, this is not limitative and the high strength spring of this invention can be of any other form than the coil spring.

EXAMPLES

Examples of this invention are shown in the form of coil springs for internal combustion engines together with prior art references.

Five examples A, B, C, D and E of this invention and two prior art references F and G are taken up and respectively made of steels shown in Table 1. The steels are of oil temper wires from

TABLE 1

| | Chemical Composition (wt %) | | | | | | | | | | | | |
|---|---|---|---|---|---|---|---|---|---|---|---|---|---|
| Type | C | Si | Mn | Cr | V | Mo | Nb | Ta | P | S | Other elements | Fe | |
| Ex. A | 0.60 | 1.25 | 0.54 | 0.55 | 0.075 | — | — | — | 0.016 | 0.011 | *3 | Bal | |
| Ex. B | 0.61 | 1.25 | 0.57 | 0.56 | — | 0.035 | 0.075 | — | 0.017 | 0.009 | *3 | Bal | |
| Ex. C | 0.65 | 1.43 | 0.67 | 0.70 | 0.108 | — | — | — | 0.014 | 0.009 | Cu: 0.01, *3 | Bal | |
| Ex. D | 0.66 | 1.46 | 0.63 | 0.71 | 0.051 | 0.040 | — | 0.046 | 0.016 | 0.012 | *3 | Bal | |
| Ex. E | 0.70 | 1.56 | 0.75 | 0.77 | 0.110 | — | 0.080 | — | 0.016 | 0.013 | *3 | Bal | |
| Ref. F | 0.55 | 1.54 | 0.71 | 0.72 | — | — | — | — | 0.018 | 0.013 | *1 | Bal | SWOSC-V |
| Ref. G | 0.55 | 1.54 | 0.71 | 0.72 | — | — | — | — | 0.018 | 0.013 | *2 | Bal | SWOSC-V* |

*1 content of non-metallic inclusions: equal to or smaller than 0.03% maximum particle size of non-metallic inclusions: equal to or smaller than 50 μm
*2 content of non-metallic inclusions: equal to or smaller than 0.01% maximum particle size of non-metallic inclusions: equal to or smaller than 15 μm
*3 content of non-metallic inclusions: equal to or smaller than 0.01% maximum particle size of non-metallic inclusions: equal to or smaller than 15 μm which valve springs are formed for test of their durabilities through measurement of their room temperature mechanical properties and room temperature fatigue characteristics. SWOSC-V and SWOSC-V* are taken up for forming the prior art references.

Firstly, wires of 4 mm in diameter and having the compositions of the examples A, B, C, D and E and the references F and G shown in Table 1 are prepared, and experiments are made thereto to know their tensile strengths $\sigma_B$ (Kgf/mm$^2$) and the reduction of area $R_A$ (%) when oil temper is performed under various conditions.

The spring wire of the larger tensile strength is more beneficial when used as a valve spring. Normally, as the tensile strength increases, the reduction of area $R_A$ reduces, thus deteriorating the could coiling characteristic. Further, in case of forming a valve spring from spring wire of typical diameter of 4 mm, it is desirable in view of the productivity that the reduction of area $R_A$ is equal to or larger than 40%.

EXPERIMENT 1

Experiments were conducted to the examples of this invention and the prior art references to measure the maximum tensile strengths when $R_A$ (%)=40.

TABLE 2

| Maximum Tensile Stengths of Various Oil Temper Wires when $R_A$ = 40% | |
|---|---|
| Type | Tensile Strength (Kg/mm$^2$) |
| Ex. A | 209 |
| EX. B | 212 |
| Ex. C | 214 |
| Ex. D | 215 |
| Ex. E | 218 |
| Ref F | 197 |
| Ref. G | 199 |

As will be apparent from the experimental result shown in Table 2, the examples A, B, C, D and E of this invention are all capable of attaining a high strength suited for use as a valve spring.

Each oil temper wires that exhibit the maximum tensile strengths shown in Table 2 when $R_A$ =40% are formed into a coiled shape of spring contant (K) of 6.0 Kgf/mm and thereafter treated by two steps of shot peening in accordance with the necessities. By this, the examples A, B, C, D and E and the references G and F each have the maximum residual compression stress of 95±1 kgf/mm$^2$ and the maximum surface roughness Rmax of 10±1 μm. However, in case of the prior art references F and G, it was only possible to increase the maximum residual compression stress up to 80 to 82 Kgf/mm$^2$ under the condition where the surface roughness Rmax is maintained at 10±1 μm, the references G and F were therefore so formed as to have the maximum residual compression stress of 81±1 Kgf/mm$^2$.

EXPERIMENT 2

The examples and the references were subjected to experiments, by using a spring testing machine under the condition that the average stress applied is maintained constantly at 65 Kgf/mm$^2$ and the stress is applied variously in amplitude and repeatedly up to $10^7$ times, to measure the fatigue limit which is determined by the maximum stress amplitude which does not cause breakage of the valve spring. The experiment result is shown in Table 3.

TABLE 3

| Fatigue Limit Stress | |
|---|---|
| Type | Fatigue Limit Stress (Kgf/mm$^2$) |
| Ex. A | 62.7 |
| Ex. B | 63.1 |
| Ex. C | 63.5 |
| Ex. D | 63.9 |
| Ex. E | 64.4 |
| Ref. F | 48.2 |
| Ref. G | 54.0 |

As will be apparent from Table 3, the fatigue limits of the examples A, B, C, D and E of this invention are all higher than those of the references F and G.

EXPERIMENT 4

Experiments were conducted to the example C of this invention to know how the size of the non-metallic inclusions affects the fatigue limit.

The spring wires respectively produced by several independent lots so as to have the composition according to the example C of this invention are formed, similarly as above, into a coiled shape having a spring constant of 6.0 Kgf/mm and then treated by a shot peening process or the like so as to have the maximum residual compression stress of 95±1 Kgf/mm$^2$ and the surface roughness Rmax of 10±1 μm, thus being formed into valve springs which are then subjected to attest by a spring testing machine in the similar manner described as above to measure limit. After this test, the non-metallic inclusions at or adjacent the breakage portion spring are observed by using a microscope thereby to know the maximum particle size of the non-metallic inclusions. The relation between the maximum particle size of the non-metallic inclusions and the fatigue limit is shown in FIG. 1.

As is apparent from the experimental result shown in FIG. 1, reduction of the fatigue limit is scarcely observed when the particle size of the non-metallic inclusions is smaller than 15 μm. When, however, the size of the non-metallic inclusions exceeds 15 82 m it is observed that considerable reduction and scatter of the fatigue limit occurs.

EXPERIMENT 5

Figure 2:
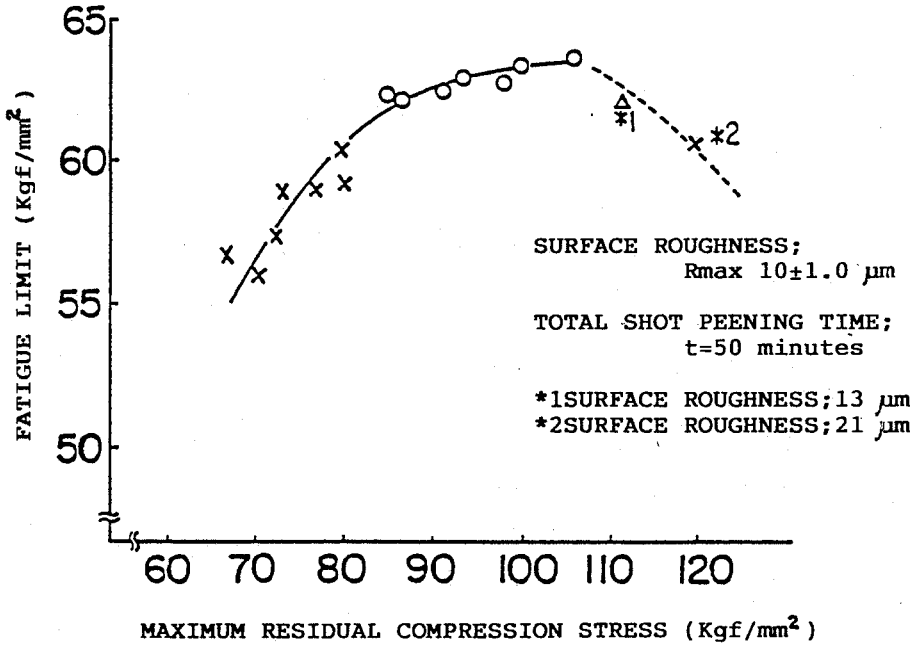
FIG. 2 is a graph depicting an experimental result of a relation between a maximum residual stress and a fatigue limit of springs when the surface roughness is maintained substantially constant throughout the springs.

Further, by using the valve spring wire having the composition according to the example E of the present invention is formed into a coiled shape having a spring constant (K) of 6.0 Kgf/mm and thereafter treated by various shot peening processes which differ in processing conditions from one another for thereby obtaining various valve springs having various maximum residual compression stresses and various surface roughnesses. The valve springs thus produced are tested by using a spring testing machine under the similar conditions described as above to measure the fatigue limits. FIG. 2 shows a relation between the maximum residual compression stress and the fatigue limit when the surface roughness is maintained substantially constant. Further, FIG. 3 shows a relation between the surface roughness and the fatigue limit stress when the maximum residual compression stress is maintained substantially constant.

As is apparent from the experiment result shown in FIG. 2, when the maximum residual compression stress is equal to or larger than 85 Kgf/mm$^2$ reduction of the fatigue limit is relatively small but when exceeds 110 Kgf/mm$^2$ the surface roughness is increased, thus adversely reducing the fatigue limit.

Figure 3:
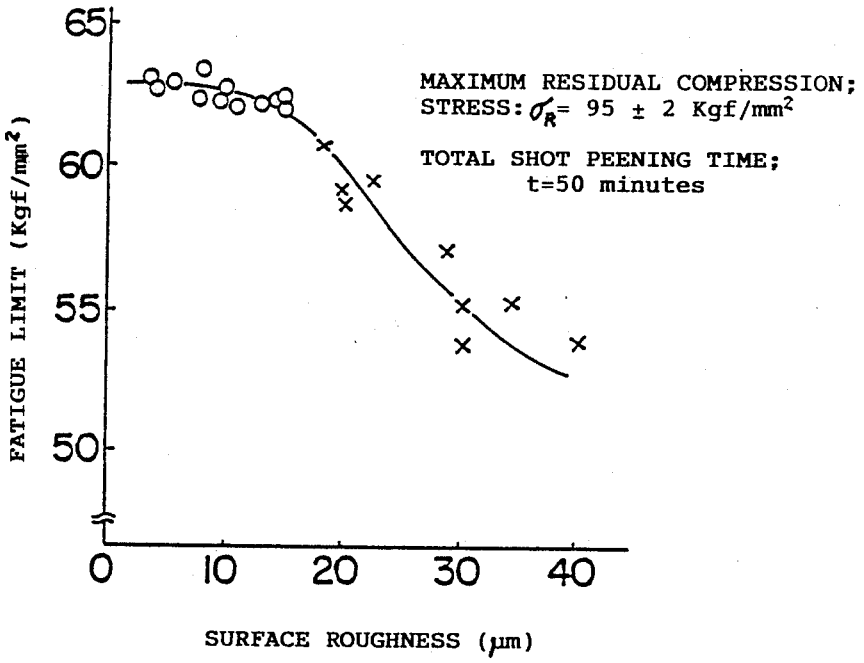
FIG. 3 is a graph depicting an experimental result of a relation between a surface roughness and a fatigue limit of springs when the maximum residual stress is maintained substantially constant throughout the springs.

Further, as will be apparent from the result of FIG. 3, when the surface roughness Rmax exceeds 15 μm, reduction of the fatigue limit stress becomes large. Further, it will be understood that even when the surface is smoothed so that the surface roughness Rmax is smaller than 5 μm, increase of the fatigue limit stress is quite small.

EXPERIMENT 6

The valve springs according to the example C and reference G and designed for 2.0 liter gasoline engine with the same safety factor are prepared and installed in the engine to measure the critical engine speed at which a valve surging does not occur. The experimental result is shown in Table 4.

TABLE 4

| Comparison of Critical Engine Speed | |
|---|---|
| Type | Critical Engine Speed (rpm) |
| Ex. C | 6820 |
| Ref G | 6390 |

From the Table 4, it is seen that the example C of this invention makes it possible to increase the critical engine speed by 430 rpm as compared with that of the prior art reference by the effect of the reduced inertia mass and the raised natural frequency.

From the foregoing, it will be understood that the valve spring of this invention has a high fatigue strength as compared with the prior art valve spring, thus making it possible to increase the critical engine speed.

It will be further understood that if the critical engine speed is determined to be constant the maximum valve lifting load can be lowered, thus making it possible to reduce the friction of the valve train and thereby improve the fuel consumption.

It will be further understood that the valve spring of the present invention is improved in the heat resistant and setting characteristic, thus making it possible to increase the safety factor if designed with the same design standards, thus making it possible to increase the reliability of the product.

What is claimed is:

1. A high strength spring of steel having the following composition by weight:

carbon: 0.6 to 0.7%
silicon: 1.2 to 1.6%
Manganese: 0.5 to 0.8%
Chromium: 0.5 to 0.8%
0.05 to 0.2% of at least one of the group consisting of vanadium, molybdenum, niobium and tantalum, the remainder being iron and inevitable impurities, and
non-metallic inclusions having maximum particle size equal to or smaller than 15 μm;
the spring having been applied with a residual compression stress at a portion adjacent the outer surface thereof in such a way that the maximum of said residual compression stress ranges from 85 to 110 kgf/mm$^2$, and wherein
the spring has a surface roughness equal to or smaller than 15 μm.

2. The high strength spring as set forth in claim 1, wherein said surface roughness ranges from 5 to 15 μm.

3. The high strength spring as set forth in claim 1, wherein the steel is formed of wire having a reduction of area equal to or larger than 40%.

4. A method of producing a high strength spring, comprising the steps of:

preparing steel of a composition which consists essentially of 0.6 to 0.7 wt % of carbon 1.2 to 1.6 wt % silicon, 0.5 to 0.8 wt % of manganese, 0.5 to 0.8 wt % of chromium, 0.05 to 0.2 wt % in total of at least one of vanadium, molybdenum, niobium and tantalam, and the balance of iron and inevitable impurities, and maximum particle size of non-metallic inclusions being limited so as to be equal to or smaller than 15 μm;
forming a spring from said steel;
applying a residual compression stress adjacent the outer surface of said spring in such a manner that the maximum of said residual compression stress ranges from 85 to 110 kgf/mm$^2$; and
processing said spring in such a way that the surface roughness is equal to or smaller than 15 μm.

5. The method as set forth in claim 4 wherein said surface roughness ranges from 5 to 15 μm.

6. The method as set forth in claim 5 wherein said steel is wire and has a reduction of area that is equal to or larger than 40%.

* * * * *